United States Patent [19]

Sweeney et al.

[11] 4,222,746

[45] Sep. 16, 1980

[54] DIESEL FUEL CONTAINING WAX OXIDATES TO REDUCE PARTICULATE EMISSIONS

[75] Inventors: William M. Sweeney, Wappingers Falls; Harold G. Sprague, Fishkill, both of N.Y.

[73] Assignee: Texaco Inc., White Plains, N.Y.

[21] Appl. No.: 32,991

[22] Filed: Apr. 25, 1979

[51] Int. Cl.[2] ..... C10L 1/30

[52] U.S. Cl. ..... 44/68; 123/1 A

[58] Field of Search ..... 44/57, 66, 68; 252/55; 123/1 A

[56] References Cited

U.S. PATENT DOCUMENTS

| | | | |
|---|---|---|---|
| 2,807,524 | 9/1957 | Tench | 44/68 |
| 2,839,552 | 6/1958 | Shapiro et al. | 44/68 |
| 2,862,803 | 12/1958 | Oosterhout | 252/55 |
| 2,894,970 | 7/1959 | McKinley et al. | 252/55 |
| 2,978,472 | 4/1961 | Kirkwood et al. | 252/55 |
| 3,294,685 | 12/1966 | Stevens et al. | 44/68 |

*Primary Examiner*—Winston A. Douglas
*Assistant Examiner*—Y. Harris-Smith
*Attorney, Agent, or Firm*—Carl G. Ries; Robert A. Kulason; Henry W. Archer

[57] ABSTRACT

Addition of 0.1 to 1.5 percent by weight of wax oxidates to a diesel fuel is found to reduce the amount of soot and invisible particles produced when the fuel is used in a diesel engine. The wax oxidates act synergistically with fuel-soluble organometallic compounds such as alkyl cyclopentadienyl manganese tricarbonyl complex salts in reducing particulates. The wax oxidates used have a ratio of Neutralization Number to Saponification Number below about 0.40 and a Saybolt Universal Viscosity at 210° F. higher than 1600.

3 Claims, No Drawings

DIESEL FUEL CONTAINING WAX OXIDATES TO REDUCE PARTICULATE EMISSIONS

BACKGROUND OF THE INVENTION

1. Field of the Invention

This invention relates to means and a process for reducing exhaust emissions of diesel fuels. More particularly, the invention is concerned with reducing the amount of invisible particulates in diesel engines exhaust emissions. The invention also relates to a method for operating a diesel engine in such a manner that there is produced a minimum of harmful obnoxious exhaust smoke by that engine.

Diesel fuels used in diesel engines give off in the exhaust of the engine particulates which recent tests show to be harmful pollutants. These particulates include not only those that exist as visible smoke when the diesel engine is overloaded or when the engine is worn or dirty, but also those that are invisible and emerge from partly loaded clean diesel engines. The Federal Environmental Protection Agency recently determined that diesel-powered automobiles emit unacceptable high levels of air pollution which must be reduced to ward off a possible health hazard.

Tests of 10 foreign and domestic cars showed many of the vehicles emitted particulate matter, in amounts greatly exceeding the agency's proposed standard for diesel-powered autos.

The proposed standards would allow six-tenths of a gram per mile for 1981 model cars, to be reduced to two-tenths of a gram per mile by the 1983 model year.

2. Description of the Prior Art

The prior art to which this invention relates is aware specifically of coassigned U.S. Pat. No. 2,941,876 which discloses a hydrocarbon fuel composition having incorporated therein a high ester content, high viscosity oxidate capable of performing the dual function of an anticorrosion and a sludge dispersant in the fuel. The oxidates are characterized by a ratio of Neutralization Number to Saponification Number below about 0.25 and an SUS viscosity at 210° F. of at least about 1500 to 20,000.

Also relevant to the present invention are U.S. Pat. Nos. 2,916,454; 3,410,670; 3,413,102; 3,539,312 and 3,499,742. These patents show smoke suppressants are commonly employed in, or added to, diesel fuel oils, particularly when the diesel engines are to be operated in areas of high population density. In general, most common smoke suppressants employed are the organic compounds of barium, particularly the barium carbonate overbased barium sulfonates which are effective for substantially reducing the amount of smoke exhaust from a diesel engine. There are questions concerning the use of barium compounds as smoke suppressants, however, it is well know that some barium compounds are toxic to ingestion by human beings at high dosages. Calcium compounds, particularly calcium carbonate overbased calcium sulfonate, have been proposed to replace the barium carbonate overbased barium compounds in diesel fuels. However, the calcium carbonate overbased calcium sulfonates have not enjoyed any appreciable degree of use because of a number of serious disadvantages connected with their use. The last mentioned patent discloses a smoke inhibited fuel composition comprising a hydrocarbon distillate fuel containing smoke suppressing amounts of a calcium alkyl phenolate or sulfurized calcium alkylphenolate overbased with calcium 2-methoxyethoxide alone or with calcium hydroxide-2-methoxy-ethoxide. None of these patents is concerned with reducing the amount of both soot and invisible particulates emitted by diesel engines.

OBJECTS AND SUMMARY OF THE INVENTION

The main object of this invention is to provide diesel fuel compositions which, emit during use, reduced amounts of particulate combustion products.

Other objects and advantages of the invention will be apparent from the following description and the appended claims.

The fuel of the present invention comprises a hydrocarbon diesel composition containing from 0.1 to 1.5 weight percent of a wax oxidate characterized by a ratio of Neutralization Number to Saponification Number below about 0.40 and Saybolt Universal viscosity at 210° F. higher than 1600. Optionally a synergistic amount of a fuel soluble organometallic compound such as alkyl cyclopendienyl manganese tricarbonyl, ferrocene and iron pentacarbonyl can be added to the fuel. The method of the invention comprises supplying to, and burning the fuel in a diesel engine. Whenever the expression "diesel fuel" is employed in the following description and claims, it is to be understood that it designates that hydrocarbon fraction which distills in a range higher than kerosine. Its property requirements are those given on Page 11-37 of the "Petroleum Processing Handbook" 1967 Edition. Generally, the diesel fuel will comprise a mixture of hydrocarbons boiling in the range of 350° to 700° F.

DISCLOSURE OF THE INVENTION

In accordance with the invention, the diesel fuel is modified by the incorporation therein of from about 0.1 to about 1.5 weight percent of a waxy oxidate and optionally from about 0.1 to about 1.5 weight percent of the previously mentioned organometallic compounds.

The wax oxidates used in the present invention preferably are produced by reacting mineral oils or petrolatum with air in the presence of a catalyst at a temperature between 270° and 400° F. at a pressure below 20 psig and at an air rate between 15 and 35 cu ft. of air per pound of reactant per hour. A more complete explanation of the method of preparation and examples thereof are set forth in U.S. Pat. No. 2,705,241.

The invention is further illustrated in detail in the following examples.

EXAMPLE I

One half percent by weight of a wax oxidate prepared from a light solvent neutral oil is added to a diesel fuel and reduces the particulates from a diesel engine by about 25 percent as compared with the engines burning the same fuel without the oxidate. The addition of 0.1 weight percent of the wax oxidate produced 3 percent reduction.

EXAMPLE II

Proceeding as in Example I but using 1.5 weight percent of a wax oxidate washed with alkali to remove acidic materials gave the same results.

EXAMPLE III

This example shows that wax oxidates act synergistically with methylcyclopentadienyl mangenese tricarbonyl (MMT) in reducing particulate emission.

A diesel fuel containing ½ weight percent MMT and ½ weight percent of a wax oxidate produced from a light solvent neutral oil reduces particulate emission by 40% as compared with the pure fuel.

The same fuel with ½ weight percent MMT alone reduces such emissions by 10 percent while the addition of wax oxidate alone reduces the emissions by 25 percent as compared with the base fuel.

EXAMPLE IV

Proceeding as in Example III, substantially similar results are obtained when ferrocene is used in place of MMT.

EXAMPLE V

Proceeding as in Example III, substantially similar results are obtained when iron pentacarbonyl is used instead of MMT.

The effectiveness of the fuel and of the method of the invention were determined by burning pure fuel and treated fuel in automotive diesel engines and running the exhaust into a dilution tube equipped with a Millipore filter which was weighed before and after combustion. Tests are run at 25 miles per hour road load, 40 mph road load, at 55 mph grade. The effect on particulate production of advanced, standard and retarded injection timing for each of the additives at each of the load is noted.

While the foregoing examples illustrate preferred embodiments of the invention, it is to be understood that their teachings can be used in fuels whenever advantageous.

Obviously, many modifications and variations of the invention as hereinbefore set forth may be made without departing from the spirit and scope thereof, and therefore only such limitations should be imposed thereon as are indicated in the appended claims.

What is claimed is:

1. A fuel composition comprising a mixture of hydrocarbons boiling in the range of 350° to 700° F. containing from 0.1 to 1.5 weight percent each of a wax oxidate characterized by a ratio of Neutralization Number to Saponfication Number below about 0.40 and an SUS viscosity at 210° of above 1500 and of a fuel soluble organometallic compound, said amount being sufficient to reduce particulate emission upon combustion of said fuel.

2. The composition of claim 1, wherein said compound is an alkylcyclopentadienyl manganese tricarbonyl complex salt, ferrocene or iron pentacarbonyl.

3. A method for reducing the soot and invisible particulate in the exhaust of a diesel engine which comprises supplying to and burning in said engine a composition as defined in claim 1.

* * * * *